United States Patent [19]

Marulic et al.

[11] Patent Number: 4,813,359

[45] Date of Patent: Mar. 21, 1989

[54] SINGLE AXLE RAILROAD TRUCK WITH FRAME IMPROVEMENTS

[75] Inventors: Walter J. Marulic, Cumming; Kenneth H. Smith, Powder Springs, both of Ga.

[73] Assignee: Thrall Car Manufacturing Company, Chicago Heights, Ill.

[21] Appl. No.: 100,425

[22] Filed: Sep. 24, 1987

[51] Int. Cl.[4] ..... B61F 5/52

[52] U.S. Cl. ..... 105/199.5; 105/206.2; 228/154

[58] Field of Search ..... 105/157.1, 182.1, 199.5, 105/206.1, 206.2; 228/154

[56] References Cited

U.S. PATENT DOCUMENTS

| | | | |
|---|---|---|---|
| 507,974 | 10/1893 | Crosby | 228/154 |
| 1,431,687 | 10/1922 | Sage et al. | 105/206.2 X |
| 1,760,955 | 6/1930 | Moss | 228/154 X |
| 3,467,415 | 9/1969 | Sandor | 403/3 X |
| 4,133,268 | 1/1979 | Guillaumin | 105/206.2 X |
| 4,242,966 | 1/1981 | Holt et al. | 105/182.1 |
| 4,542,280 | 9/1985 | Simons | 228/154 X |
| 4,596,311 | 6/1986 | Brodeur et al. | 188/198 X |

*Primary Examiner*—Stephen Hepperle

*Attorney, Agent, or Firm*—Marshall, O'Toole, Gerstein, Murray & Bicknell

[57] ABSTRACT

A railroad single axle truck having a pair of wheels with one wheel at each end of the axle, the truck including a frame having a pair of longitudinal spaced apart parallel horizontal side tubes of substantially equal length, the frame also including a pair of transverse spaced apart parallel horizontal beams of substantially equal length positioned normal to and substantially planar to the longitudinal side tubes, the beams being spaced apart for a distance longer than the length of the tubes with the side tubes positioned between the beams, and the end of each side tube having a joining member telescoped thereto and fixedly joined to the side tube with the member having an outer end fixedly joined to the beam.

7 Claims, 3 Drawing Sheets

FIG. 3
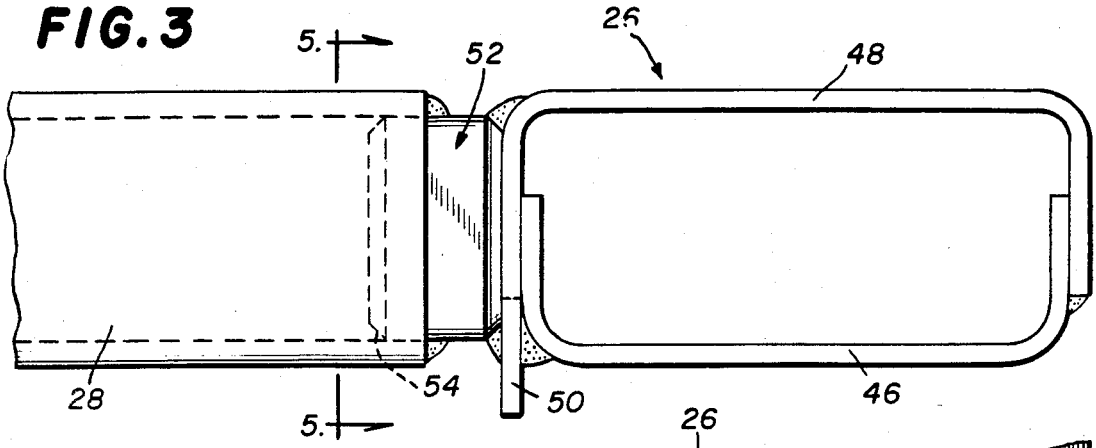
FIG. 4
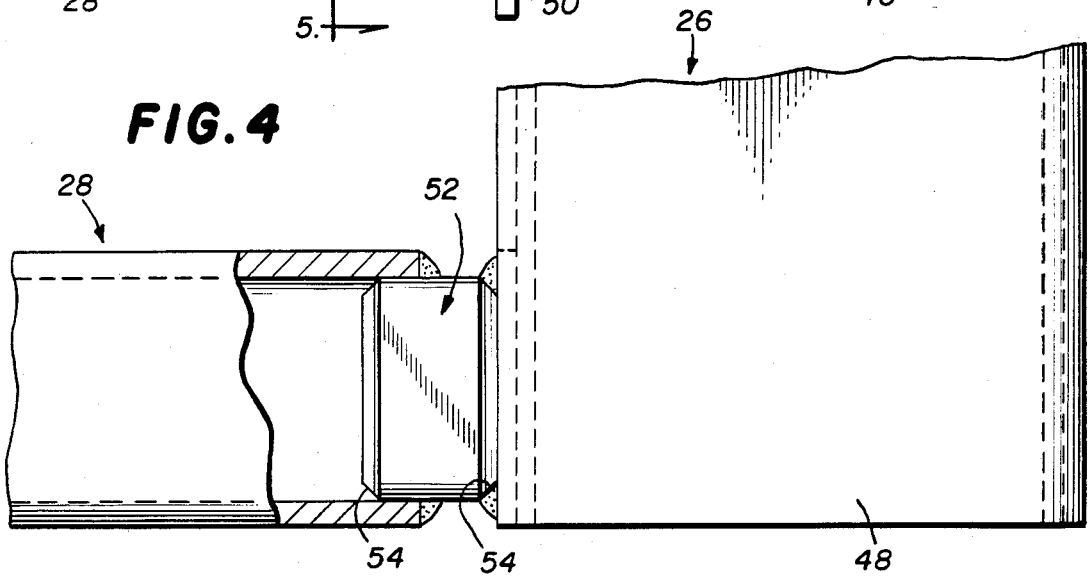
FIG. 5
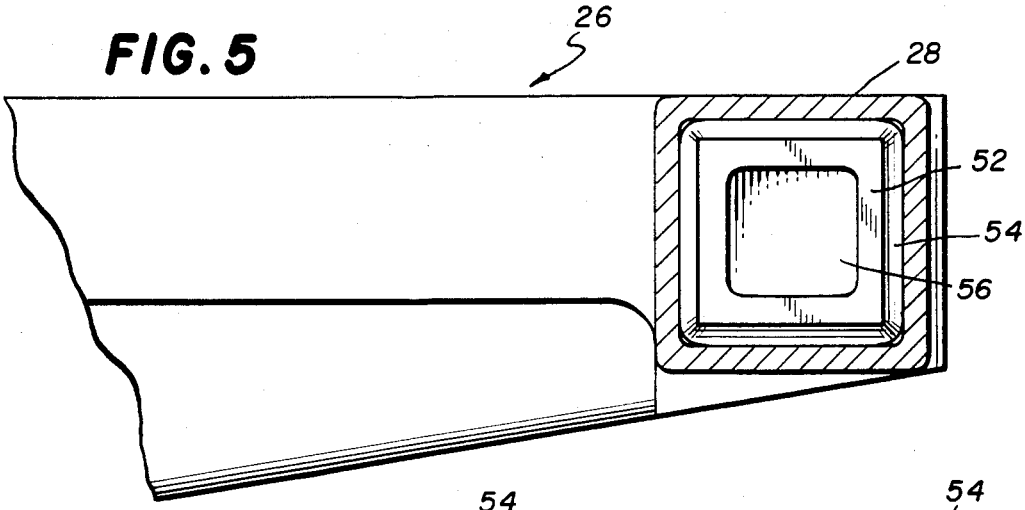
FIG. 6
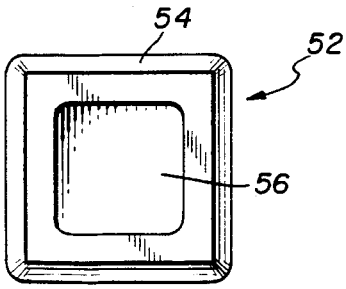
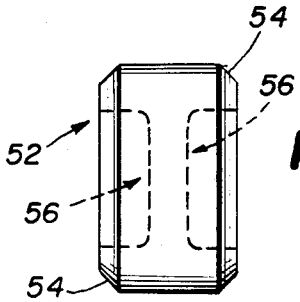
FIG. 7

FIG. 8
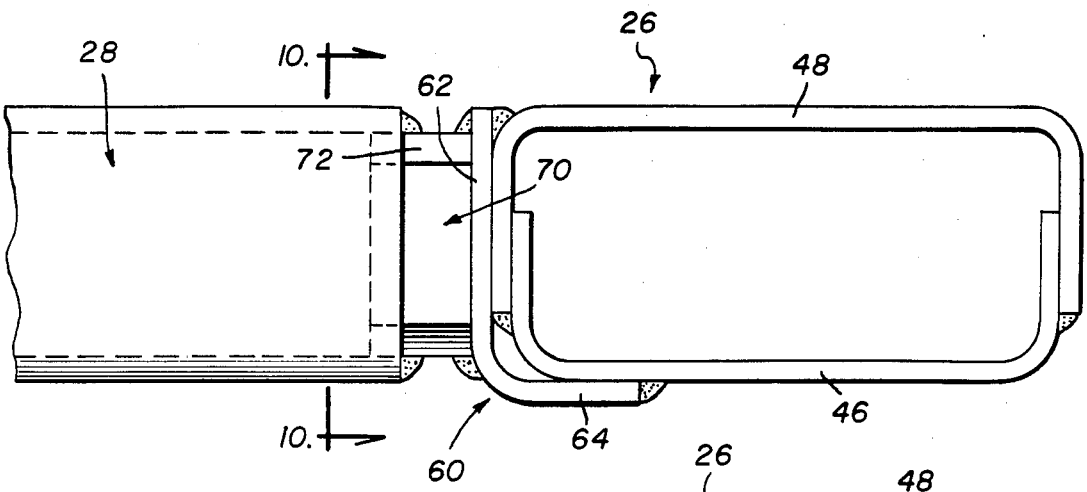
FIG. 9
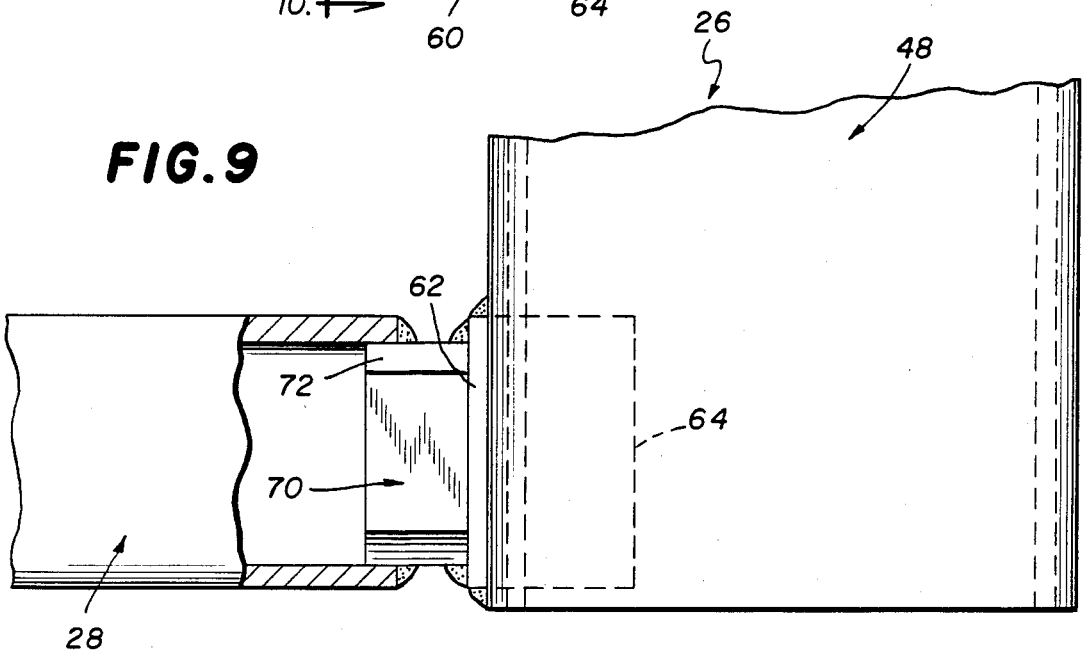
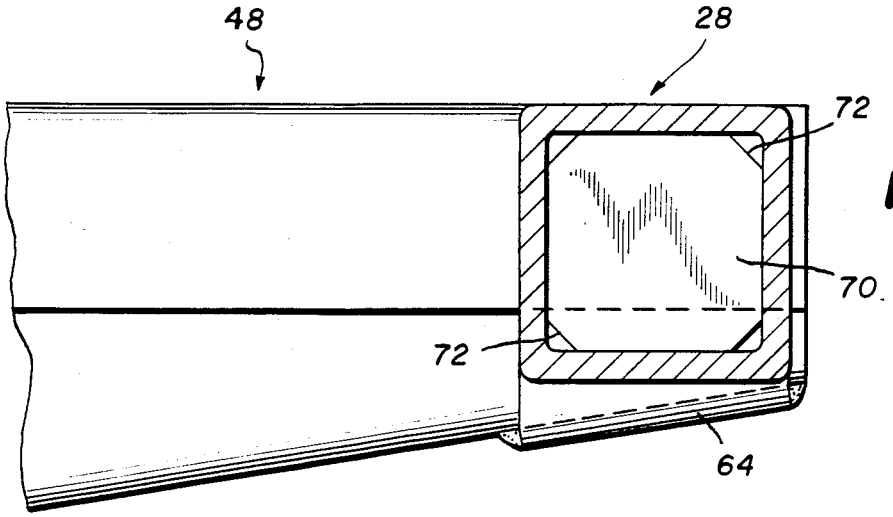
FIG. 10

SINGLE AXLE RAILROAD TRUCK WITH FRAME IMPROVEMENTS

This invention relates to railroad cars. More particularly, this invention relates to improvements in the frames of single axle railroad trucks.

BACKGROUND OF THE INVENTION

Railroad freight cars in the United States have almost exclusively employed double axle four wheel trucks. In recent years, however, freight cars for relatively light loads, such as piggy back trailers and containers, have employed single axle two wheel trucks at each end. The U.S. patents of Brodeur et al U.S. Pat. No. 4,596,311 and Terlecky U.S. Pat. No. 4,636,119 disclose such railroad cars.

The Brodeur et al U.S. Pat. No. 4,596,311 discloses a particular type of single axle two wheel truck having a truck frame fabricated with two transverse beams and two side tubes. The railroad car center sill is supported at each end by the frames of such trucks. The springs and wheel assembly of each truck are operatively connected to the frame. One such truck in commercial use is conventionally referred to as a U.I.C. or International Union of Railways truck.

Conventional construction of a railroad car with such a truck is to apply the axle guard, which limits horizontal, vertical and lateral movement of the truck axle, as a subassembly to each of the longitudinal spaced apart side tubes. This is not readily accomplished, however, because of tight tolerances between centers of the two transverse beams, axle guard and the side tubes. Also, the ends of the tubes required beveling for welding and sometimes the tube ends had to be cut to an intricate contour when the beam did not provide an abutting planar or flat surface.

In addition, it is not unusual for the frames of such single axle trucks to be damaged in use and to require replacement of one or more transverse beams and side tubes. This is not readily done with frames having the present construction.

From the above it is clear that a new frame construction is needed for single axle two wheel trucks which are readily fabricated initially and easily repaired later if damaged.

SUMMARY OF THE INVENTION

According to the invention a railroad single axle truck is provided having a pair of wheels with one wheel at each end of the axle; the truck including a frame having a pair of longitudinal spaced apart parallel horizontal side tubes of substantially equal length; the frame also including a pair of transverse spaced apart parallel horizontal beams of substantially equal length positioned normal to and substantially planar to the longitudinal side tubes; the beams being spaced apart for a distance longer than the length of the tubes with the side tubes positioned between the beams; and an end of at least one side tube having a joining member telescoped thereto and fixedly joined to the side tube with the member having an outer end fixedly joined to the beam.

A joining member can be telescoped into one end of one tube, one end of both tubes or both ends of both tubes. When a joining member is used on only one end of one tube, the other end of that tube can be joined directly to the adjacent beam. It is highly desirable, however, to use a joining member at each end of each tube, for a total of four joining members, because this permits ready centering and alignment of equipment supported by the tubes by single longitudinal displacement of one or both tubes before being welded to the joining members.

Each beam can have a substantially vertical planar side wall adjacent the side tube end and the joining member outer end can be joined to the vertical side wall.

The joining member can be a joining plug partially telescoped into the end of the side tube and projecting out therefrom into contact with the beam. The joining member outer end can be vertical and planar so as to abut the beam vertical planar surface to make a welded joint readily.

Each beam can comprise two structural channels, with the side walls of one channel projecting vertically upwardly and nesting with the side walls of the second channel which projects vertically downwardly. The vertical side of the beam, adjacent the side tube end, can be made planar if necessary by a tab, or by an angle member joined to the end with the angle member having both a vertical flange and a horizontal flange joined to the beam so that the vertical flange provides an outer planar vertical surface to which a joining member vertical surface can be joined.

By having the side tubes shorter than the distance between the beams, and telescoping the joining members into the side tube ends, a slip joint connection is provided which permits the effective length of the side tubes to be increased to exactly the distance between the beams. Also, the side tube ends do not require beveling since they can be cut square and fillet welded to the plug. The outer end of the joining plug joined to the beam can be prebeveled when the plug is made as a casting or forging.

Should a side tube be damaged in service, the tube can be replaced by removing the welds connecting the tube ends to the plugs and sliding a new tube over each plug, which are retained attached to the beams.

BRIEF DESCRIPTION OF THE DRAWINGS

FIG. 3 is an enlarged side elevational view of one end of a side tube joined to a transverse beam according to the invention;

FIG. 4 is a plan view of the side tube and beam structure shown in FIG. 3;

FIG. 5 is a sectional view taken along the line 5—5 of FIG. 3;

FIG. 6 is an end view of the telescoping joining plug shown in FIGS. 1 to 5;

FIG. 7 is an end view of the joining plug shown in FIG. 6;

FIG. 8 is a side elevational view similar to FIG. 3 but showing an angle member joined to the side of the beam between the joining plug end and the beam;

FIG. 9 is a plan view of the side tube and beam structure shown in FIG. 8; and FIG. 10 is a sectional view taken along the line 10—10 of FIG. 8.

DETAILED DESCRIPTION OF THE DRAWINGS

Figures 1, 2:
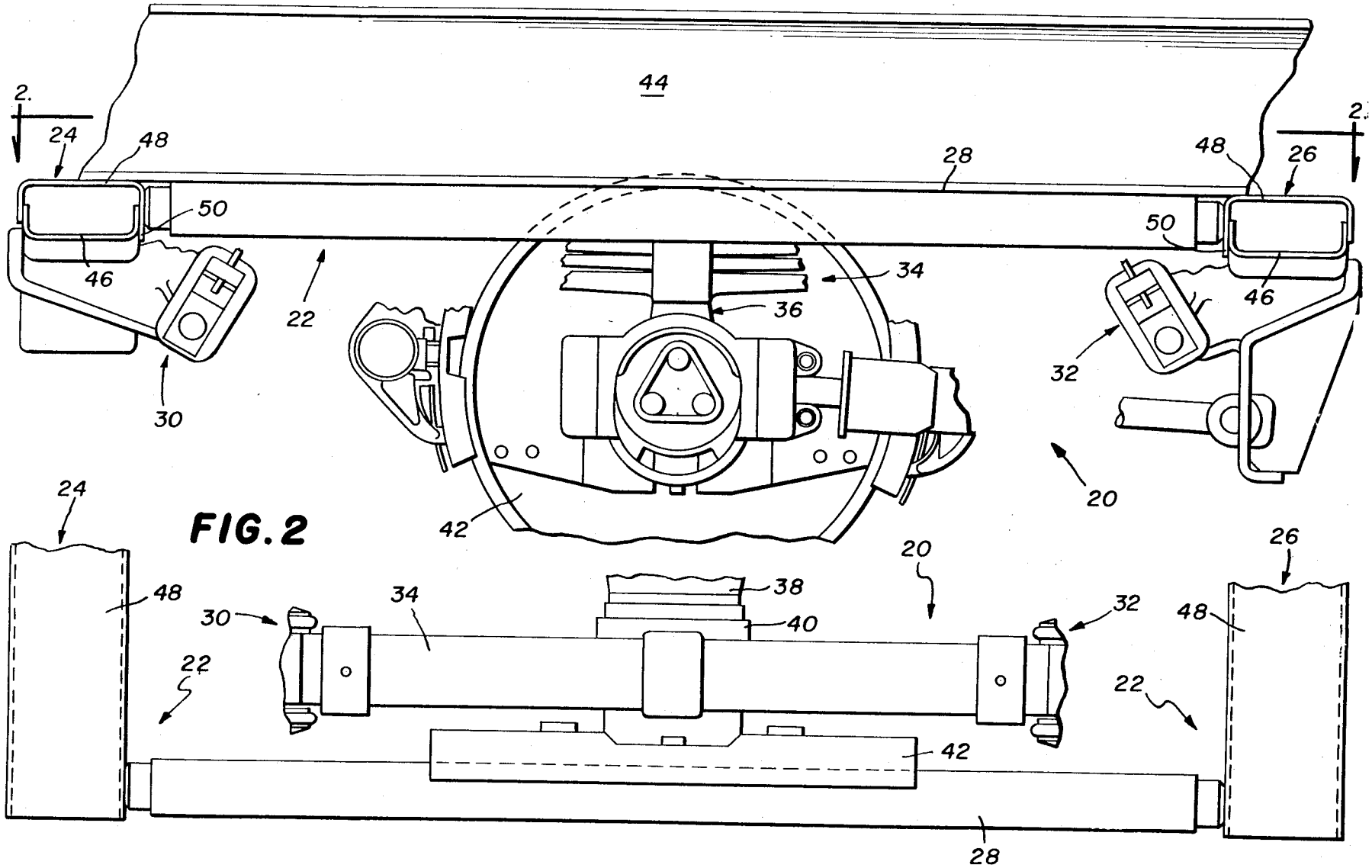
FIG. 1 is a side elevational view of a railroad car having a single axle truck with a frame according to the invention.
FIG. 2 is a partial sectional view taken along the line 2—2 of FIG. 1.

To the extent it is reasonable and practical the same or similar elements present in the various views of the drawings will be identified by the same numbers.

With reference to FIGS. 1 and 2, the single axle railroad truck 20 shown in these drawings, with the exception of the improvements provided by this invention, is a type in commercial use which is conventionally referred to as a U.I.C. truck. The truck 20 includes a frame 22 having a pair of spaced apart parallel transverse beams 24,26 of equal length and a pair of longitudinal spaced apart parallel side tubes 28, only one of which is illustrated, it being understood that both side tubes are identical to one another and are joined to the beams in the same way.

The opposing ends of beams 24,26 have swing hangers 30,32 to which the ends of leaf type truck springs 34 are connected. The truck springs 34 are operably connected to a bearing box support 36. The end of the axle 38 is rotatably mounted in bearing box 40, A wheel 42 is mounted on the axle 38 inward of the bearing box. A longitudinal center beam 44 is supported at each end by a truck 20. The center beam 44 is fixedly joined to the center of beams 24,26. Additional details of the described truck structure and its use in a railroad car are disclosed in Brodeur et al U.S. Pat. No. 4,596,311.

Each of the side tubes 28 is substantially identical and of the same length but shorter than the distance between beams 24,26. In cross section side tubes 28 are square but they can be rectangular.

The transverse beams 24,26 are substantially identical and have the same length. Each of the beams 24,26 is fabricated from a pair of structural channels of different width. As shown in FIG. 3, the lower channel 46 has an outer width about equal to the inner width of inverted upper channel 48 with which it is united in nesting arrangement by suitable fillet welds. An extension tab 50 is joined to the vertical face of each beam 24,26, adjacent an end of side tube 28, below the lower edge of the adjacent flange of channel 26. In this way a vertical planar surface is provided on beams 24,26 adjacent the ends of side tubes 28.

A joining plug 52 is telescoped into each end of each side tube 28. The plug 52 is essentially square in lateral section except for the side edges which are rounded to accommodate it to the internal contour of the side tube 28 which has rounded internal corners. The side walls of plug 52 are dimensioned to fit close to the internal side walls of tube 28 but with freedom so that the plug can slide without binding. The plug end edges 54 are beveled to facilitate placing the plug 52 in the end of side tube 28 and welding it to side beams 24,26. A longitudinal recess 56 in each end of the plug reduces its weight. However, the plug could be solid.

A second embodiment of the invention is illustrated by FIGS. 8 to 10. This embodiment is particularly useful in repairing or rebuilding used railroad trucks which have been damaged and require installation of one or more side tubes 28 or transverse beams 24,26. The used trucks in service lack the tab 50 so an alternative means is needed to provide a vertical planar surface to which the outer end of a joining plug can be attached.

As shown in FIGS. 8 to 10, a short angle member 60 is connected to each end of each beam 24,26. The vertical flange 62 of angle member 60 is joined to the side wall of the beam 24 or 26 and the horizontal flange 64 is joined to the bottom of the beam. Vertical flange 62 provides an outer planar surface to which the vertical planar end of solid joining plug 70 can be contacted and then joined by welding. The side edges of plug 70 are beveled 72 so that it can slide freely when telescoped into the end of side tube 28.

Regardless of which embodiment of the invention is used to form a truck frame, even when the beams 24,26 are in fixed position as part of a used truck or in fabricating a new truck the side tubes 28 with a joining plug 52 or 70 partially telescoped in each end can be placed in position between the beam ends. Then the plugs can be welded to the beams and to the side tubes. Whenever a transverse beam or side tube is damaged it can be cut out and be replaced by a new one since a frame fabricated according to the invention makes such repair convenient and inexpensive.

The foregoing detailed description has been given for clearness of understanding only, and no unnecessary limitations should be understood therefrom, as modifications will be obvious to those skilled in the art.

What is claimed is:

1. A railroad single axle truck having a pair of wheels with one wheel at each end of the axle;

the truck including a frame having a pair of longitudinal spaced apart parallel horizontal side tubes of substantially equal length;

the frame also including a pair of transverse spaced apart parallel horizontal beams of substantially equal length positioned normal to and substantially planar to the longitudinal side tubes;

the beams being spaced apart for a distance longer than the length of the tubes with the side tubes positioned between the beams;

each beam comprising two structural channels, with the side walls of one channel projecting vertically upwardly and nesting with the side walls of the second channel which projects vertically downwardly;

an angle member joined at each end of each beam;

the angle member having both a vertical flange and a horizontal flange joined to the beam;

the vertical flange providing an outer planar vertical surface;

at least one end of a side tube having a joining member telescoped thereto and fixedly joined to the side tube; and the joining member having an outer end with a vertical surface fixedly joined to the angle member outer planar vertical surface.

2. A railroad single axle truck having a pair of wheels with one wheel at each end of the axle;

the truck including a frame having a pair of longitudinal spaced apart parallel horizontal side tubes of substantially equal length;

the frame also including a pair of transverse spaced apart parallel horizontal beams of substantially equal length positioned normal to and substantially planar to the longitudinal side tubes;

the beams being spaced apart for a distance longer than the length of the tubes with the side tubes positioned between the beams;

each beam comprising two structural channels, with the side walls of one channel projecting vertically upwardly and nesting with the side walls of the second channel which projects vertically downwardly;

the end of each side tube having a joining member telescoped thereto and fixedly joined to the side tube;

a tab means which provides a vertical planar surface on the beam adjoining the end of the joining member; and the joining member having an outer end fixedly joined to the beam and the tab means.

3. A railroad single axle truck having a pair of wheels with one wheel at each end of the axle;

the truck including a frame having a pair of longitudinal spaced apart parallel horizontal side tubes of substantially equal length;

the frame also including a pair of transverse spaced apart parallel horizontal beams of substantially equal length positioned normal to and substantially planar to the longitudinal side tubes;

the beams being spaced apart for a distance longer than the length of the tubes with the side tubes positioned between the beams;

each beam comprising two structural channels, with the side walls of one channel projecting vertically upwardly and nesting with the side walls of the second channel which projects vertically downwardly;

an angle member joined at each end of each beam;

the angle member having both a vertical flange and a horizontal flange joined to the beam;

the vertical flange providing an outer planar vertical surface;

the joining member having a vertical surface joined to the angle member outer planar vertical surface;

the end of each side tube having a joining member telescoped thereto and fixedly joined to the side tube; and the joining member having an outer end with a vertical surface fixedly joined to the angle member outer planar vertical surface.

4. A railroad truck according to claim 3 in which the joining member is a joining plug partially telescoped into the end of the side tube and projecting out therefrom into contact with the angle member outer planar vertical surface.

5. A railroad single axle truck having a pair of wheels with one wheel at each end of the axle;

the truck including a frame having a pair of longitudinal spaced apart parallel horizontal side tubes of substantially equal length;

the frame also including a pair of transverse spaced apart parallel horizontal beams of substantially equal length positioned normal to and substantially planar to the longitudinal side tubes;

the beams being spaced apart for a distance longer than the length of the tubes with the side tubes positioned between the beams;

at least one end of a side tube having a joining member telescoped thereto and fixedly joined to the side tube with the joining member having an outer end fixedly joined to the beam;

an angle member joined at each end of each beam;

the angle member having both a vertical flange and a horizontal flange joined to the beam;

the vertical flange providing an outer planar vertical surface; and the joining member having a vertical surface joined to the angle member outer planar vertical surface.

6. A railroad single axle truck having a pair of wheels with one wheel at each end of the axle;

the truck including a frame having a pair of longitudinal spaced apart parallel horizontal side tubes of substantially equal length;

the frame also including a pair of transverse spaced apart parallel horizontal beams of substantially equal length positioned normal to and substantially planar to the longitudinal side tubes;

the beams being spaced apart for a distance longer than the length of the tubes with the side tubes positioned between the beams;

the end of each side tube having a joining member telescoped thereto and fixedly joined to the side tube with the member having an outer end fixedly joined to the beam; and a tab means on the beam which provides a vertical planar surface adjoining the end of the joining member.

7. A railroad single axle truck having a pair of wheels with one wheel at each end of the axle;

the truck including a frame having a pair of longitudinal spaced apart parallel horizontal side tubes of substantially equal length;

the frame also including a pair of transverse spaced apart parallel horizontal beams of substantially equal length positioned normal to and substantially planar to the longitudinal side tubes;

the beams being spaced apart for a distance longer than the length of the tubes with the side tubes positioned between the beams;

the end of each side tube having a joining member telescoped thereto and fixedly joined to the side tube with the member having an outer end fixedly joined to the beam;

an angle member joined at each end of each beam;

the angle member having both a vertical flange and a horizontal flange joined to the beam;

the vertical flange providing an outer planar vertical surface; and the joining member having a vertical surface joined to the angle member outer planar vertical surface.

* * * * *